US005822668A

United States Patent [19]

Fromm et al.

[11] Patent Number: 5,822,668

[45] Date of Patent: Oct. 13, 1998

[54] FUSER SUBSYSTEM MODULE FOR AN ELECTROPHOTOGRAPHIC PRINTER WHICH PIVOTS OPEN FOR JAM CLEARANCE

[75] Inventors: Paul M. Fromm, Rochester; Angelo L. Barisone, Ontario, both of N.Y.

[73] Assignee: Xerox Coporation, Stamford, Conn.

[21] Appl. No.: 837,934

[22] Filed: Apr. 11, 1997

[51] Int. Cl.[6] ..... G03G 15/20

[52] U.S. Cl. ..... 399/323

[58] Field of Search ..... 399/322, 323, 399/320, 400, 122, 21

[56] References Cited

U.S. PATENT DOCUMENTS

| | | | |
|---|---|---|---|
| 4,065,120 | 12/1977 | Imaizumi et al. | 399/323 X |
| 4,475,804 | 10/1984 | Kanno et al. | 399/323 |
| 5,200,785 | 4/1993 | Hoover et al. | 399/122 |
| 5,533,193 | 7/1996 | Roscoe | 395/183.15 |
| 5,623,720 | 4/1997 | Howe et al. | 399/323 |

*Primary Examiner*—S. Lee

*Attorney, Agent, or Firm*—R. Hutter

[57] ABSTRACT

A fuser subsystem module for an electrophotographic printer or copier pivots open to allow access to the fuser nip and the stripper finger area. Mechanisms in the module cause the sharp stripper fingers to retract when the module is opened, and also enable a stripper plate against the pressure roll to be properly oriented against the pressure roll when the module is closed.

10 Claims, 3 Drawing Sheets

FUSER SUBSYSTEM MODULE FOR AN ELECTROPHOTOGRAPHIC PRINTER WHICH PIVOTS OPEN FOR JAM CLEARANCE

FIELD OF THE INVENTION

The present invention relates to a fuser subsystem module for an electrophotographic printer or copier.

BACKGROUND OF THE INVENTION

Fusing is an essential step in the well-known process of electrostatographic printing or copying. In the fusing step, powdered toner which has been transferred in imagewise fashion onto a medium, such as a sheet of paper, is fixed, typically by a combination of heat and pressure, to form a permanent image on the medium. The basic architecture of a fuser is well known: in essentials, there is a pressure roll which rolls against a fuser roll, the image-bearing sheet passing through a nip between the rolls. The side of the medium having the image to be fixed faces the fuser roll, which is often supplied with a heat source, such as a resistance heater, at the core thereof. The combination of heat from the fuser roll and pressure between the fuser roll and pressure roll fixes the toner to form the permanent image.

In the event of a paper jam around the fusing subsystem, it is typically desirable to allow the user to open the housing of the printer or copier, and access the area immediately around the nip between the fuser roll and pressure roll. Placement of a hand near the fuser subsystem can be dangerous: not only is there a presence of high temperatures, but additional structures within the system, particularly stripper fingers for removing sheets from the surface of the fuser roll, typically have sharp edges.

DESCRIPTION OF THE PRIOR ART

U.S. Pat. No. 4,065,120 discloses a fuser subsystem having pivotably-mounted stripper fingers which are urged against the surface of a fuser roll and pressure roll.

U.S. Pat. No. 5,200,785 describes a fusing subsystem in a replaceable cartridge. The cartridge includes the fusing roller, an oil-applying structure, a heating lamp, temperature sensors, and an access opening. The cartridge electrical connector mates with a receiving electrical connector in the image-forming apparatus.

U.S. Pat. No. 5,533,193 discloses a system for use with high-volume digital printers or copiers for detecting, identifying, and retaining a running list of specific machine faults. Codes defining different machine faults are retained in a first in, first out buffer of finite size.

SUMMARY OF THE INVENTION

According to one aspect of the present invention, there is provided a fuser subsystem for an electrophotographic printer, comprising a roll, mounted in a frame, A door includes a hinge pivotably mounted to the frame. A stripper finger, springably mounted on the door, includes a tip, the stripper finger contacting the tip against a surface of the roll when the door is closed with respect to the frame, and urging the tip thereof toward the hinge when the door is open with respect to the frame. A deflector mounted on the door engages a surface of the frame and pushes the tip away from the hinge as the door approaches a closed position with respect to the frame.

According to another aspect of the present invention, there is provided a fuser subsystem for an electrophotographic printer, comprising a roll mounted in a frame. A door includes a hinge pivotably mounted to the frame. A stripper plate, springably mounted on the door, includes a tip and an side, and urges the tip thereof away from the hinge when the door is open with respect to the frame. A plate cover is movably mounted on the door, the plate cover engaging the stripper plate to push the tip of the stripper plate toward the hinge when the door is in an open position with respect to the roll. The plate cover further engages a surface of the frame to withdraw from the stripper plate to allow the side of the stripper plate to urge against the surface of the roll when the door is closed with respect to the frame.

According to another aspect of the present invention, there is provided a fuser subsystem for an electrophotographic printer, comprising a fuser roll and a pressure roll, mounted in a frame. A door includes a hinge pivotably mounted to the frame. A stripper finger, springably mounted on the door, includes a tip, the stripper finger contacting the tip against a surface of the fuser roll when the door is closed with respect to the frame, and urging the tip toward the hinge when the door is open with respect to the frame. A stripper plate, springably mounted on the door, includes a tip and an side, and urges the tip thereof away from the hinge when the door is open with respect to the frame.

DETAILED DESCRIPTION OF THE INVENTION

Figure 1:
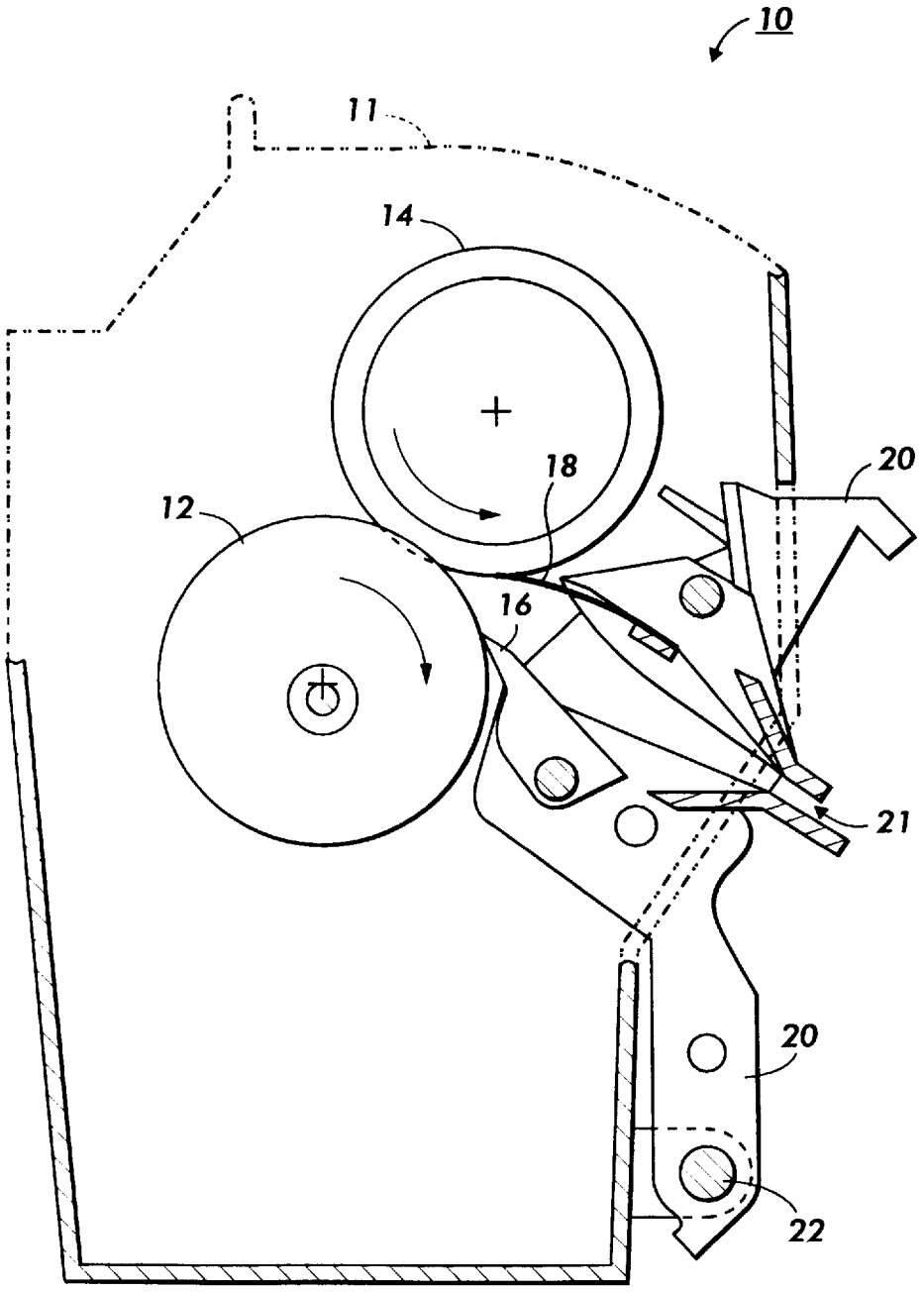
FIG. 1 is a simplified elevational view of a fusing subsystem module for a printer or copier, showing certain essential elements of the present invention.

FIG. 1 is an elevational view showing the essential elements of a fuser subsystem module incorporating the present invention. The module 10 is preferably of a design which can be readily removed and replaced in an electrophotographic printer or copier, but the essential elements of the claimed invention could be mounted permanently within a copier or printer itself. As is common with fuser subsystems, there exists at least a fuser roll 12 which rolls against a pressure roller 14. A sheet bearing an image to be fused passes through the nip between fuser roll 12 and pressure roll 14. There may further exist other elements within module 10, such as a system for cleaning and lubricating the fuser roll 12, but these are not immediately germane to the present invention.

On the "downstream" side of the nip formed between fuser roll 12 and pressure roll 14, as indicated by the arrows showing the rotation of these rolls, there exists two types of stripper fingers for gently stripping a fused sheet from the surface of one of the rolls. In the illustrated embodiment, there is provided, against the surface of fuser roll 12, a stripper finger 16 (preferably, there will be provided several stripper fingers 16 across a longitude of fuser roll 12). A stripper finger 16 is typically about 3 mm wide along the length of the fuser roll 12. With reference to pressure roll 14 there is provided what is here called a stripper plate 18. A stripper plate 18 is about 6–12 mm wide along the length of the pressure roll 14, and is generally made of a thin plate of spring steel.

In brief, the different structures of the stripper finger 16 and the stripper plate 18 relate to the different types of common faults characteristic of fuser roll subsystems. One type of fault involves partially-fused toner particles causing a sheet to adhere to the surface of fuser roll 12; this type of adhesion is addressed by a stripper finger of the design of stripper finger 16. With regard to the pressure roll 14, plastic-based media, such as transparencies, tend to adhere by static electricity to the pressure roll 14. Also, duplex prints with toner on the pressure-roll side and toner dirt that sometimes collects on pressure roll 14 may also cause print media to stick to pressure roll 14. A stripper plate such as of the design of stripper plate 18 is advantageous in addressing this type of fault. Also, thins stripper plates such as 18 are preferred for rubber-coated rolls such as pressure roll 14; stripper fingers such as shown as 16 above are preferred for the typically harder fuser rolls, and would dig in to rubber pressure rolls.

As can be seen in FIG. 1, both stripper finger 16 and stripper plate 18 are effectively mounted on what is here generally called a "door" 20. (The rest of the module 10 except for the door 20 can be considered "frame" 11.) The door 20 is pivotably mounted by a hinge 22 to frame 11 of module 10, although as mentioned above if there is no separable module 10 in a printer or copier, the door 20 can be pivotably mounted directly into the main body of the machine. In normal operation, sheets emerging from the nip pass through an opening such as 21 in door 20. The mounting of door 20 on hinge 22 enables a user to access the area immediately downstream of the nip between fuser roll 12 and pressure roll 14, such as in the case of a paper jam. Paper jamming in this area usually results in "accordioned" sheets of paper, sometimes caught under stripper finger 16 or stripper plates 18. Opening the door 20 presents the jammed sheet to the user for easy removal. A user simply lowers the door 20 to get at the nip, and the stripper fingers 16 and stripper plates 18, being mounted on door 20, are moved out of the way.

To provide a pivoting door such as 20 relative to the nip presents certain practical and safety problems. Specifically, stripper fingers 16 tend to be fairly sharp, and thus present a safety hazard for a person sticking his hand near the nip when the door is open. Further, in a preferred embodiment of the present invention, stripper plates such as 18 are intended to be urged by a spring force upward in the view of FIG. 1, so that a blade edge of the stripper plate 18 rests against a surface of pressure roll 14, as shown. If the door 20 is opened, the spring force on stripper plate 18 when the stripper plate 18 disengages from pressure roll 14 will cause the stripper plate 18 to flip upward. When the door 20 is closed again, and the tip of a stripper plate 18 is not angled correctly relative to the surface of pressure roll 14, the stripper plate 18 will "stab" and thereby damage the surface of pressure roll 14 and/or be damaged itself. The improper angel of of stripper plate 18 is also an outcome of the arc the tip of stripper plate 18 travels while rotating about hinge 22. This arc effect allows the stripper fingers 16 to approach the fuser roll 12 at a favorable angle, but the stripper plates 18 approach the pressure 14 at an unfavorable angle. There therefore exists a need to protect the hands of a user from the sharp points of stripper finger 16, and to protect the surface of pressure roll 14 from a point of a stripper plate 18.

Figure 2B:
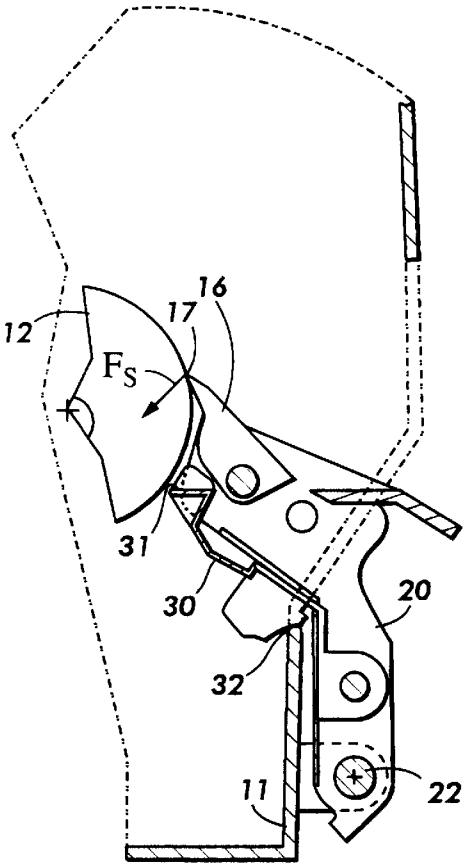
FIGS. 2A and 2B show a configuration of elements according to one aspect of the present invention, shown respectively with the fusing subsystem module being opened and closed.
Figure 2A:
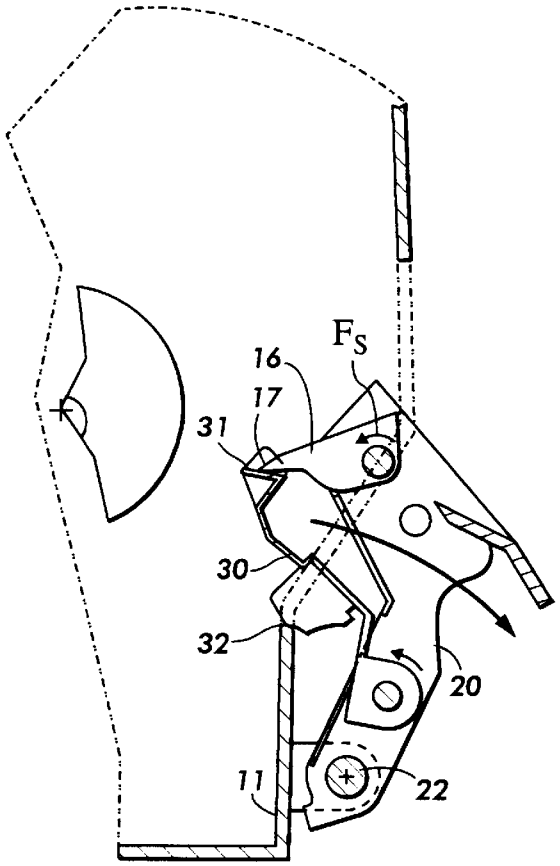

FIGS. 2A and 2B are elevational views showing one aspect of the present invention, in particular, the mounting and behavior of one stripper finger 16 relative to neighboring elements when the door 20 is respectively opened and closed. It is to be understood that, in a preferred embodiment of the present invention, there exists any number of stripper fingers such as 16 arranged across the length of a fuser roll 12. A particular stripper finger 16, in the form of the member illustrated, is pivotably mounted on door 20, and further is urged by a spring force (such as from a spring, not shown) generally counterclockwise in the view of the Figure, toward hinge 22. The spring force is preferably the same spring force used to load the stripper finger 16 against the the fuser roll 14.

As is known with stripper fingers, in order to operate successfully, the stripper finger includes a relatively sharp tip, here indicated as 17, alongside of which is an edge. The tip 17*a* is positioned so as to peel a sheet adhering to the moving surface of fuser roll 14. If tip 17 were to stab the surface of fuser roll 14, the surface would be damaged. It is therefore important to provide a mechanism which will "sit" tip 17 on the surface of fuser roll 14 while keeping it in a safe position.

When the door 20 is open, the tip 17 of stripper finger 16 fits on a deflector member 30, which is also pivotably mounted on door 20. Deflector member 30 further includes a cam-like surface which engages a rigid surface 32 (here, simply a side of the housing) on the frame 11 of the module 10 or structure within the machine. The deflector member 30 can include a protective sheath 31 around the tip 17 of stripper finger 16, such as by enclosing the tip 17 on either side thereof.

As can be seen in comparing FIGS. 2A and 2B, when the door 20 is open, the spring force $F_s$ on stripper finger 16 urges the tip 17 downward against deflector 30. This force will have the effect of pushing the tip 17 out of the way of a person's fingers reaching into the nip 12. When, as in FIG. 2B, the door 20 is closed, the cam surface of deflector member 30 slides against the surface 32 with the overall effect of pushing the tip 17 of stripper finger 16 upward, away from hinge 22, so that, by the time the door 20 is completely closed, the edge 17*b* sits properly against the surface of fuser roll 12, and no longer rests against deflector member 30.

In a practical design of the mechanism shown in FIG. 2A and 2B, the deflector member 30 preferably has flexible or resilient properties, particularly between the cam surface and the tip thereof, to allow the different mebers to fit together neatly.

Figure 3B:
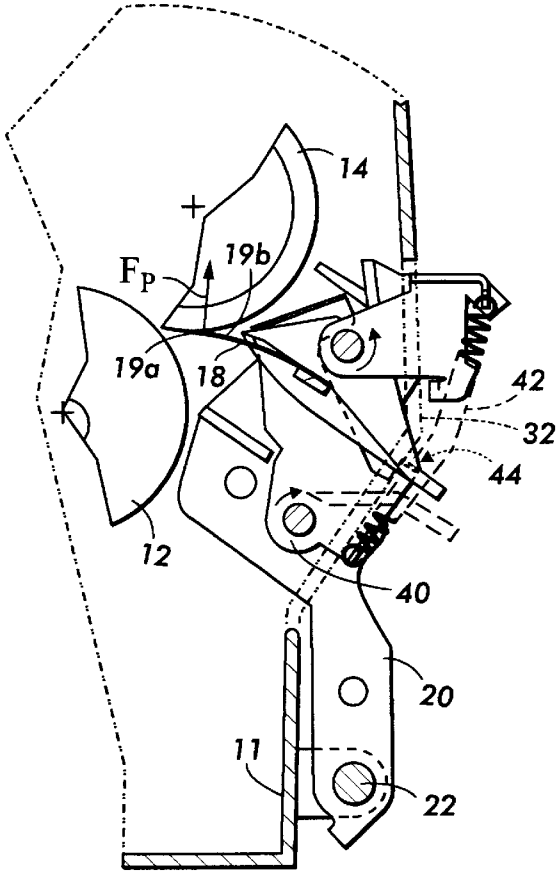
FIGS. 3A and 3B are simplified elevational views of another configuration of elements according to another aspect of the present invention, shown respectively with the fuser subsystem module being open and closed.
Figure 3A:
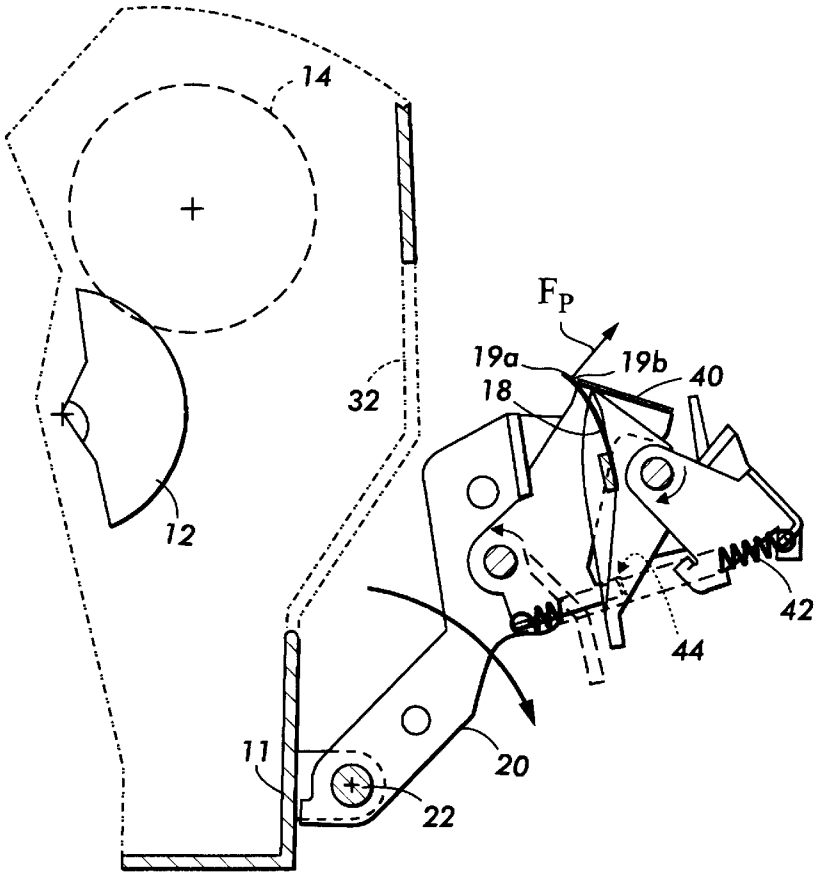

FIGS. 3A and 3B are simplified elevational views showing the essential elements of the mounting of a stripper plate 18 on a door 20, respectively when the door 20 is opened and closed. A stripper plate 18 is mounted on the door 20 in a manner by which the plate 18 can provide an upward spring force, here indicated as $F_p$, as a result of, for example, its spring steel construction. As with the stripper finger described above, stripper plate includes a tip, here indicated as 19*a*, and a side, here indicated as 19*b*; the intention is to have side 19*b* sit on the surface of pressure roll 14, and not to have tip 19*a* stab pressure roll 14.

On door 20 there is also provided a pivotably mounted plate cover indicated as 40. Plate cover 40 includes a top portion which in effect folds over the stripper plate 18, and is spring loaded by spring 42 to rotate counterclockwise as viewed in the Figure, thus pushes stripper plate downward in the view of the Figure, generally toward hinge 22. The opposite side of the plate cover 40 is attached to a coil spring 42. There is further provided, in this particular embodiment, a stopping tab 44, which in this case extends toward the viewer of the Figure, which engages a surface 32 on frame 11. (The surface 32 shown in FIGS. 3A and 3B is once again any suitable surface on frame 11, and may or may not be the same surface 32 as in FIGS. 2A and 2B.)

When the door 20 is open, as in FIG. 3A, the top portion of plate cover 40 pushes against the force $F_p$ on stripper plate 18; as shown, the spring force from coil spring 42 causes the top portion of plate cover 40 to push stripper plate 18 toward hinge 22. The movement of plate cover 40 is limited to maintain a desired relation with the tip 19*a* while door 20 is open: the plate cover 40 may extend beyond tip 19*a* for greater safety to the user, or may not not extend entirely over tip 19*a*, in order to avoid damaging the tip 19*a*.

With reference to FIG. 3B, when the door 20 is almost entirely closed, the contact of surface 32 with stopping tab 44 causes the top portion of plate cover 40 to be pushed back relative to stripper plate 18. This pushing back of the top cover of plate cover 40 will occur only after the stripper plate 18 is in a suitable position to have side 19*b* "sit" properly against the surface of pressure roll 14, as opposed to tip 19*a* "stabbing" the pressure roll 14. In this way, the stripper plate 18 can exert the force $F_p$ in the desired configuration relative to the nip, since the plate cover 40 is no longer in effective contact with stripper plate 18.

Although the mechanism for stripper finger 16 shown in FIGS. 2A and 2B has been shown separately from the mechanism for stripper plate 18 in FIGS. 3A and 3B, a preferred embodiment of the present invention would incorporate both arrangements in a single module 10.

While the invention has been described with reference to the structure disclosed, it is not confined to the details set forth, but is intended to cover such modifications or changes as may come within the scope of the following claims.

We claim:

1. A fuser subsystem for an electrophotographic printer, comprising:

a roll, mounted in a frame;

a door, including a hinge pivotably mounted to the frame;

a stripper finger, springably mounted on the door, the stripper finger including a tip, the stripper finger contacting the tip against a surface of the roll when the door is closed with respect to the frame, and the stripper finger urging the tip toward the hinge when the door is open with respect to the frame;

a deflector mounted on the door, the deflector engaging a surface of the frame and engaging the stripper finger to push the tip of the stripper finger away from the hinge as the door approaches a closed position with respect to the frame.

2. The fuser subsystem of claim 1, the stripper finger being pivotably mounted on the door.

3. The fuser subsystem of claim 1, the deflector including a sheath thereon for retaining the stripper finger when the door is open with respect to the frame.

4. The fuser subsystem of claim 1, the deflector having resilient properties.

5. A fuser subsystem for an electrophotographic printer, comprising:

a roll, mounted in a frame;

a door, including a hinge pivotably mounted to the frame;

a stripper plate, springably mounted on the door, the stripper plate including a tip and a side, the stripper plate urging the tip thereof away from the hinge when the door is open with respect to the frame;

a plate cover movably mounted on the door, the plate cover engaging the stripper plate to push the tip of the stripper plate toward the hinge when the door is in an open position with respect to the roll, the plate cover further engaging a surface of the frame to withdraw from the stripper plate to allow the side of the stripper plate to urge against a surface of the roll when the door is closed with respect to the frame.

6. The fuser subsystem of claim 5, the plate cover being springably mounted on the door.

7. The fuser subsystem of claim 5, the plate cover being pivotably mounted on the door.

8. A fuser subsystem for an electrophotographic printer, comprising:

a fuser roll, mounted in a frame;

a pressure roll, mounted in the frame and contacting the fuser roll;

a door, including a hinge pivotably mounted to the frame;

a stripper finger, springably mounted on the door, the stripper finger including a tip and an edge, the stripper finger contacting the edge against a surface of the fuser roll when the door is closed with respect to the frame, and the stripper finger urging the tip thereof toward the hinge when the door is open with respect to the frame; and a stripper plate, springably mounted on the door, the stripper plate including a tip and a side, the stripper plate urging the tip thereof away from the hinge when the door is open with respect to the frame, and contacting the pressure roll when the door is closed with respect to the frame.

9. The fuser subsystem of claim 8, further comprising a deflector, the deflector engaging a surface of the frame and engaging the stripper finger to push the tip of the stripper finger away from the hinge as the door approaches a closed position with respect to the frame.

10. The fuser subsystem of claim 8, further comprising a plate cover movably mounted on the door, the plate cover engaging the stripper plate to push the tip of the stripper plate toward the hinge when the door is in an open position with respect to the frame, the plate cover further engaging a surface of the frame to withdraw from the stripper plate to allow the side of the stripper plate to urge against a surface of the pressure roll when the door is closed with respect to the frame.

* * * * *